US011795765B2

(12) United States Patent
Ishizuka et al.

(10) Patent No.: US 11,795,765 B2
(45) Date of Patent: Oct. 24, 2023

(54) AUGER BIT

(71) Applicant: METAL TOOL INC., Aichi (JP)

(72) Inventors: Takemi Ishizuka, Aichi (JP); Takahiro Monnzaki, Gifu (JP)

(73) Assignee: METAL TOOL INC, Aichi (JP)

( * ) Notice: Subject to any disclaimer, the term of this patent is extended or adjusted under 35 U.S.C. 154(b) by 31 days.

(21) Appl. No.: 17/612,848

(22) PCT Filed: May 13, 2020

(86) PCT No.: PCT/JP2020/019046
§ 371 (c)(1),
(2) Date: Nov. 19, 2021

(87) PCT Pub. No.: WO2020/235407
PCT Pub. Date: Nov. 26, 2020

(65) Prior Publication Data

US 2022/0228445 A1 Jul. 21, 2022

(30) Foreign Application Priority Data

May 21, 2019 (JP) ..... 2019-095191

(51) Int. Cl.
*E21B 10/44* (2006.01)
*E21B 10/58* (2006.01)

(52) U.S. Cl.
CPC ..... *E21B 10/58* (2013.01); *E21B 10/44* (2013.01)

(58) Field of Classification Search
CPC ..... E21B 10/44
See application file for complete search history.

(56) References Cited

U.S. PATENT DOCUMENTS 2,005,016 A * 6/1935 Van Buskirk ..... E02F 9/2833 299/112 R
2,510,751 A * 6/1950 McLaughlin ..... E21B 10/633 175/413

(Continued)

FOREIGN PATENT DOCUMENTS

JP S56115494 A 9/1981
JP S57-047085 A 9/1983

(Continued)

OTHER PUBLICATIONS

The Japanese Office Action dated Jul. 2, 2019 for Japanese Patent Application No. 2019-095191, 10 pages.

(Continued)

*Primary Examiner* — Kipp C Wallace
(74) *Attorney, Agent, or Firm* — Lee & Hayes, P.C.

(57) ABSTRACT

An auger bit mounted on an auger head and having improved excavation efficiency is provided. The present invention is an auger bit 11 mounted on an auger head, the auger bit including: a base part 12 having a leading end protruding in an axial direction of the auger head; and two leg parts 13 and 14 continuously extending from the base part and facing each other at a predetermined interval, the base part includes a plane part 12*a* parallel to and continuous with planes of the leg parts, first tilted parts 12*b* to 12*d* that are tilted from the plane part toward a side closer to the leading end in the axial direction of the auger head, side surface parts 12*e* and 12*f* continuous with the first tilted parts, and a second tilted part 12*g* tilted from the first tilted parts toward a side closer to the leg parts in the axial direction of the auger head, and the plane part and the leg part each have a shape curved at a predetermined curvature relative to the axial direction of the auger head.

3 Claims, 13 Drawing Sheets

(56) References Cited

U.S. PATENT DOCUMENTS

| | | | | | |
|---|---|---|---|---|---|
| 3,207,242 | A * | 9/1965 | Miller | E21B 10/44 | 175/413 |
| 3,300,883 | A * | 1/1967 | Troeppl | E02F 9/2858 | 172/765 |
| 3,316,988 | A * | 5/1967 | Petersen | E21B 10/44 | 175/391 |
| 3,375,890 | A * | 4/1968 | Petersen | E21B 10/44 | 175/385 |
| 3,426,860 | A * | 2/1969 | Petersen | E21B 10/42 | 175/392 |
| 3,999,620 | A | 12/1976 | Watson | | |
| 4,170,267 | A * | 10/1979 | Bourlier | E21B 10/44 | 175/425 |
| 5,497,843 | A | 3/1996 | Burns et al. | | |
| 6,739,411 | B2 * | 5/2004 | Burns | E21B 10/02 | 175/57 |

FOREIGN PATENT DOCUMENTS

| | | | |
|---|---|---|---|
| JP | S58149491 | U | 10/1983 |
| JP | 60115991 | U | 8/1985 |
| JP | 60168896 | A | 9/1985 |
| JP | S62189292 | A | 8/1987 |
| JP | S62189293 | A | 8/1987 |
| JP | S62189294 | A | 8/1987 |
| JP | S0639670 | Y2 | 3/1988 |
| JP | H02106091 | A | 4/1990 |
| JP | H02106091 | U | 8/1990 |
| JP | H0639670 | Y2 | 1/1991 |
| JP | H0738292 | U | 7/1995 |
| JP | H08326460 | A | 12/1996 |
| JP | 2002339680 | A | 11/2002 |
| JP | 2005307496 | A | 11/2005 |
| JP | 4635375 | B2 | 2/2011 |
| JP | 6472150 | B1 | 2/2019 |

OTHER PUBLICATIONS

The European Search Report dated Apr. 25, 2023 for European Patent Application No. 20808910.2, a counterpart foreign application of U.S. Appl. No. 17/612,848, 7 pages.

* cited by examiner

[FIG.1]
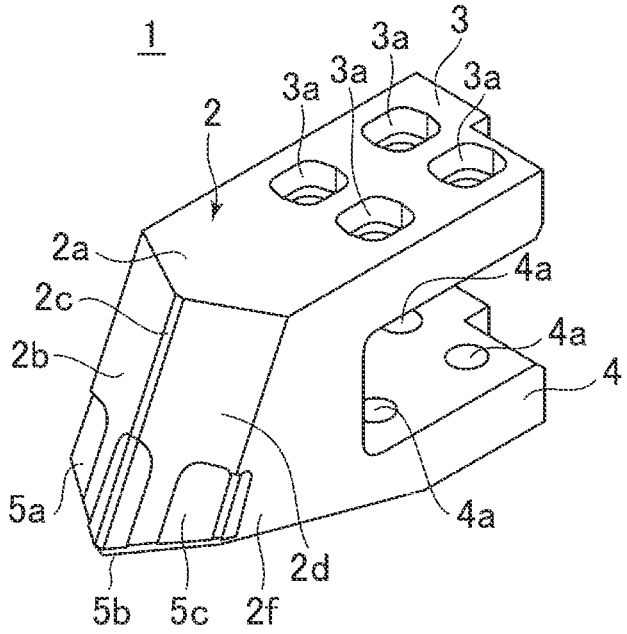

[FIG. 2]
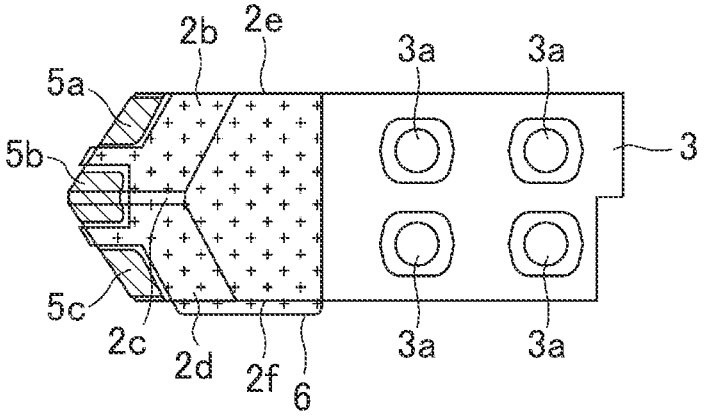
(a)
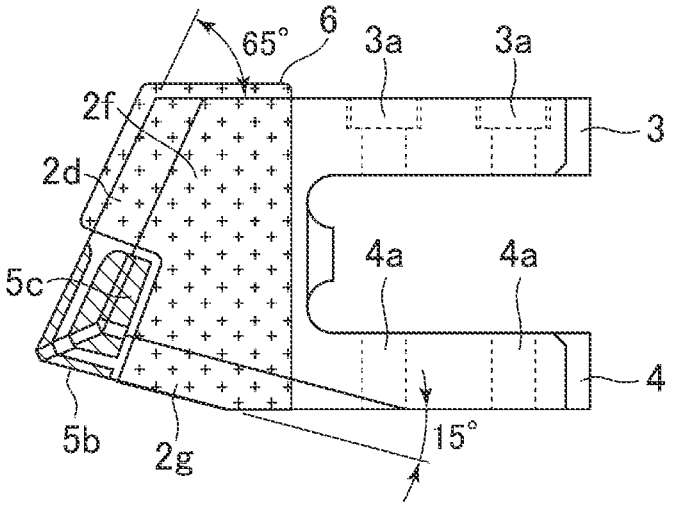
(b)

[FIG. 3]
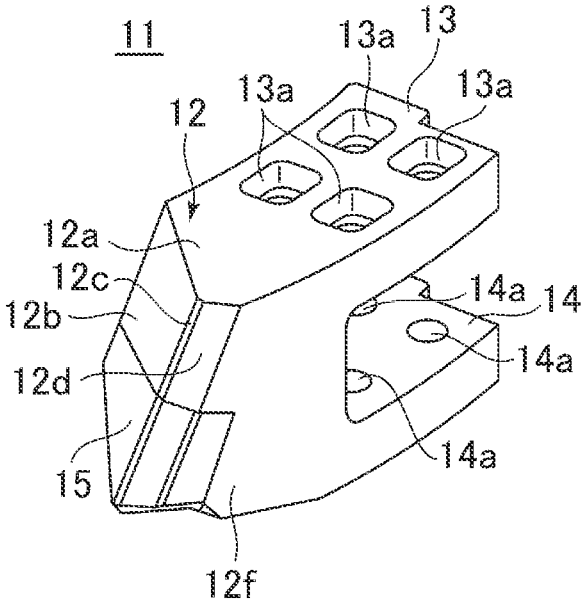

[FIG. 4]
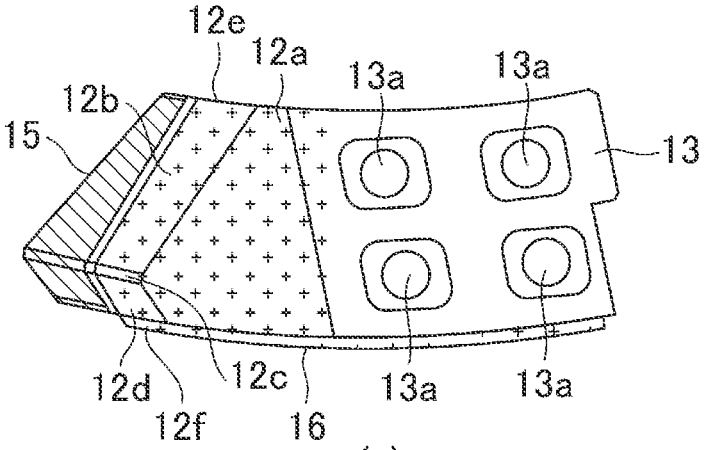
(a)
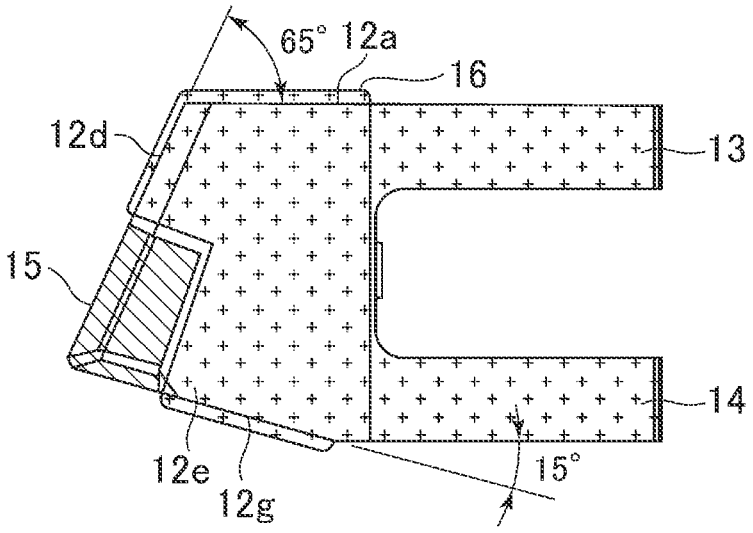
(b)

[FIG. 5]
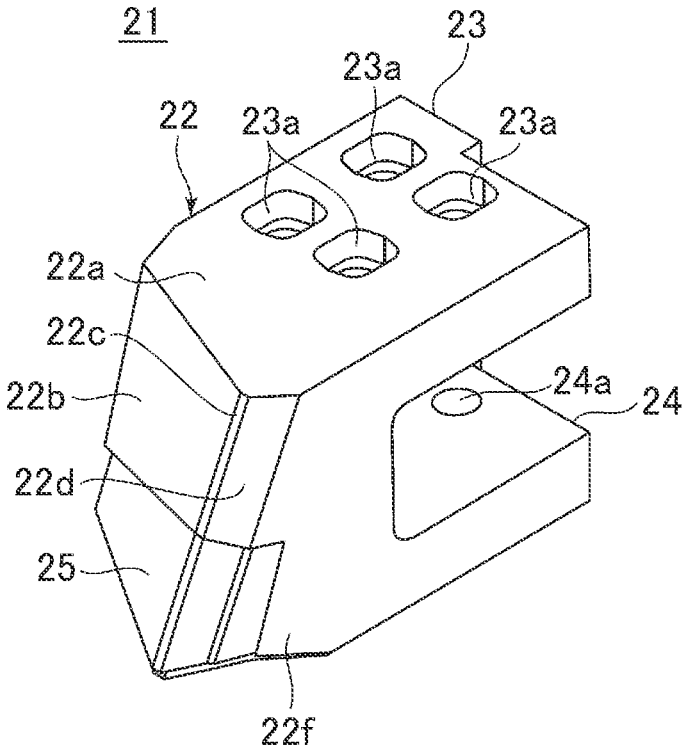

[FIG. 6]
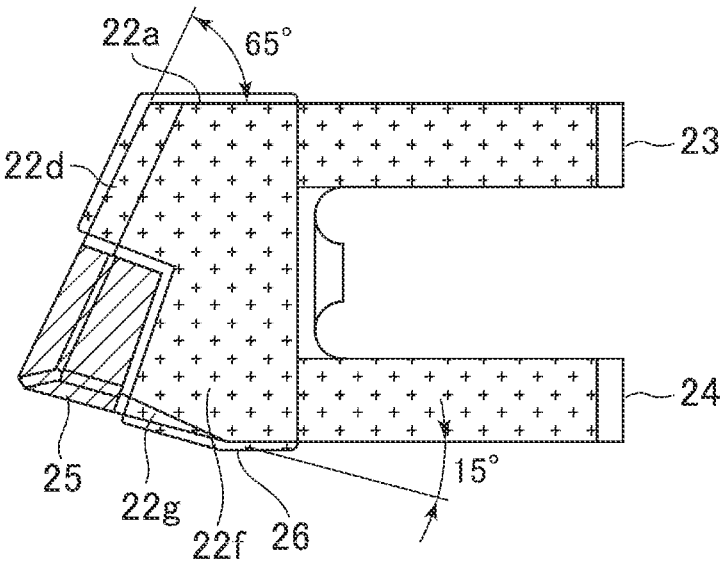
(a)
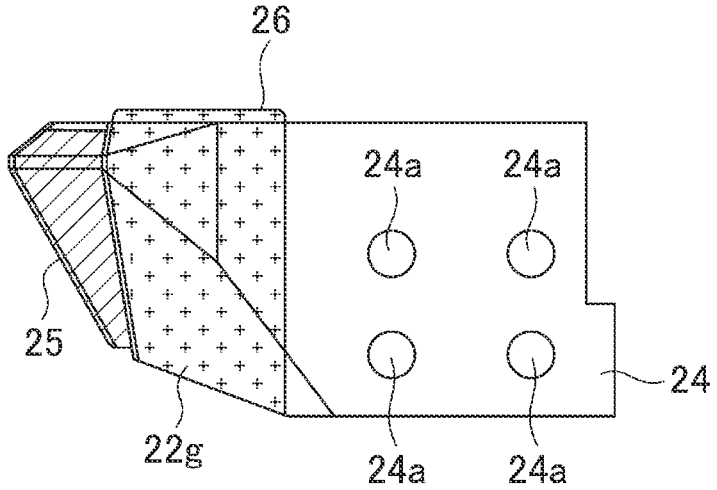
(b)

[FIG. 7]
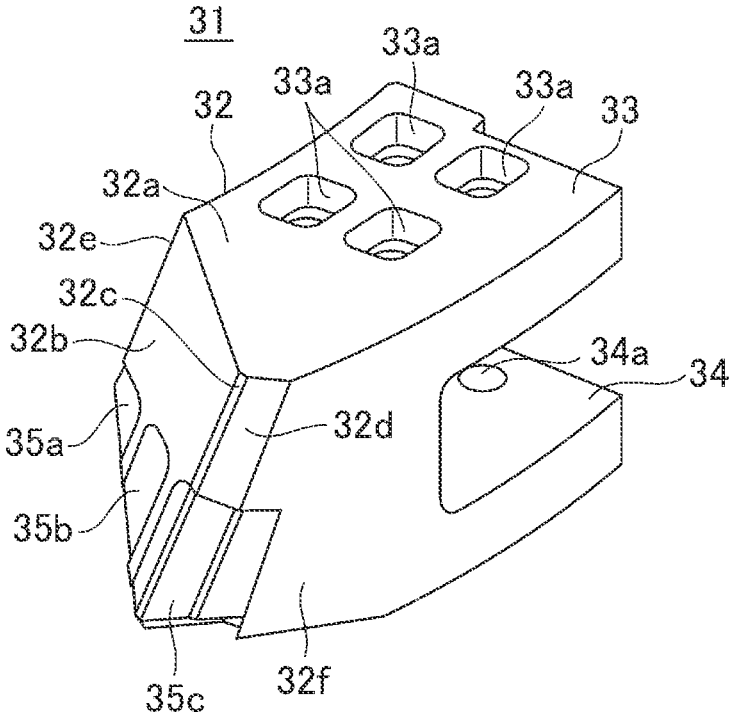

[FIG. 8]
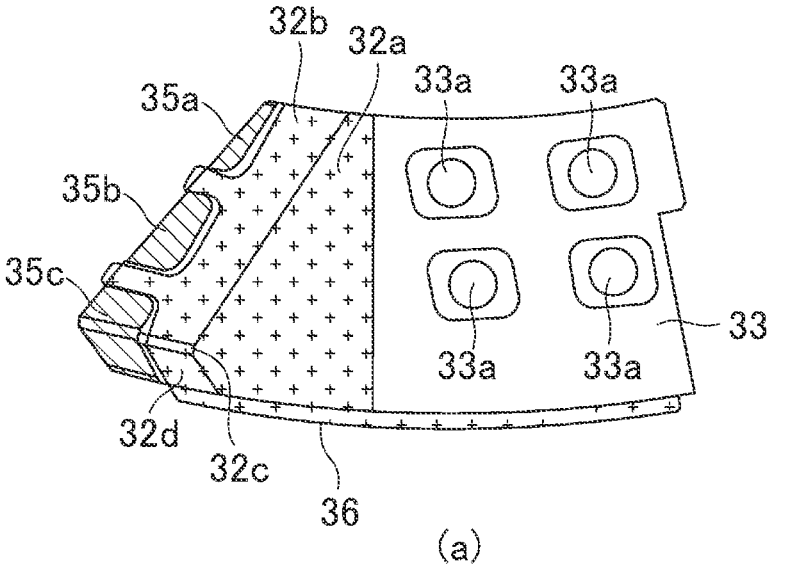
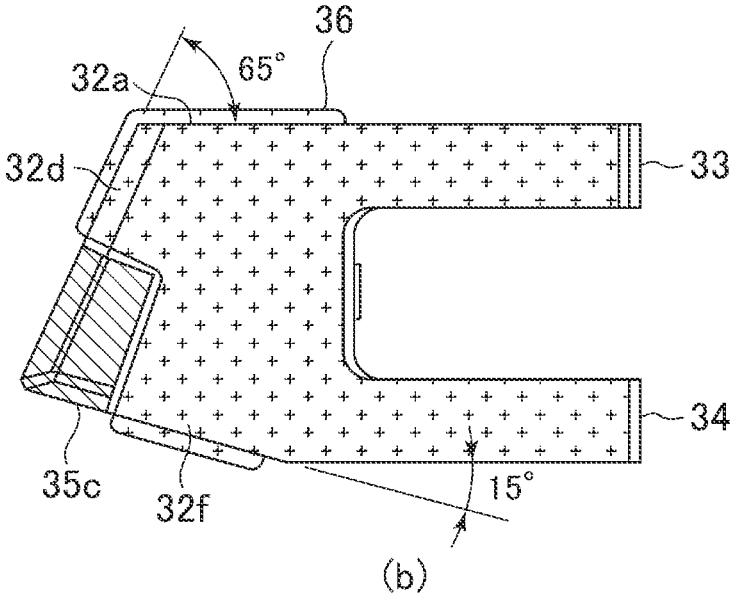

[FIG. 9]
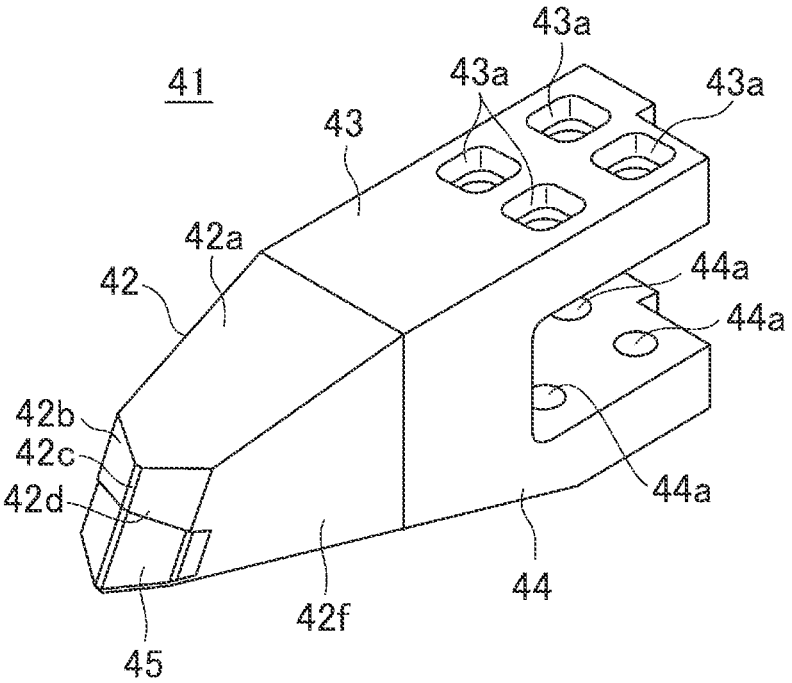

[FIG.10]
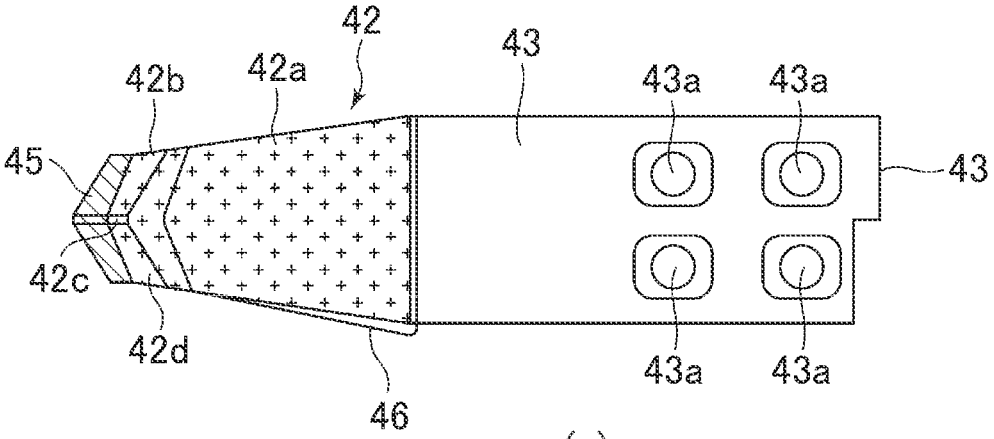
(a)
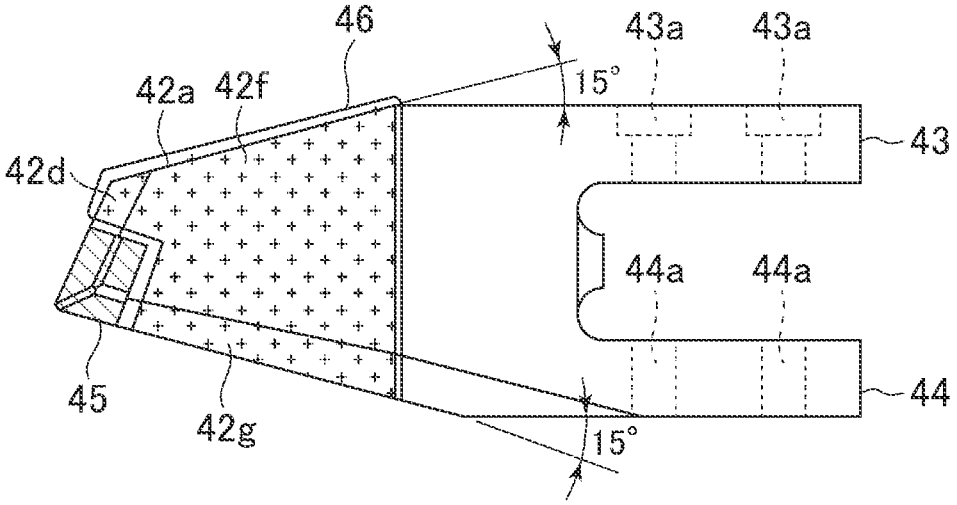
(b)

[FIG.11]
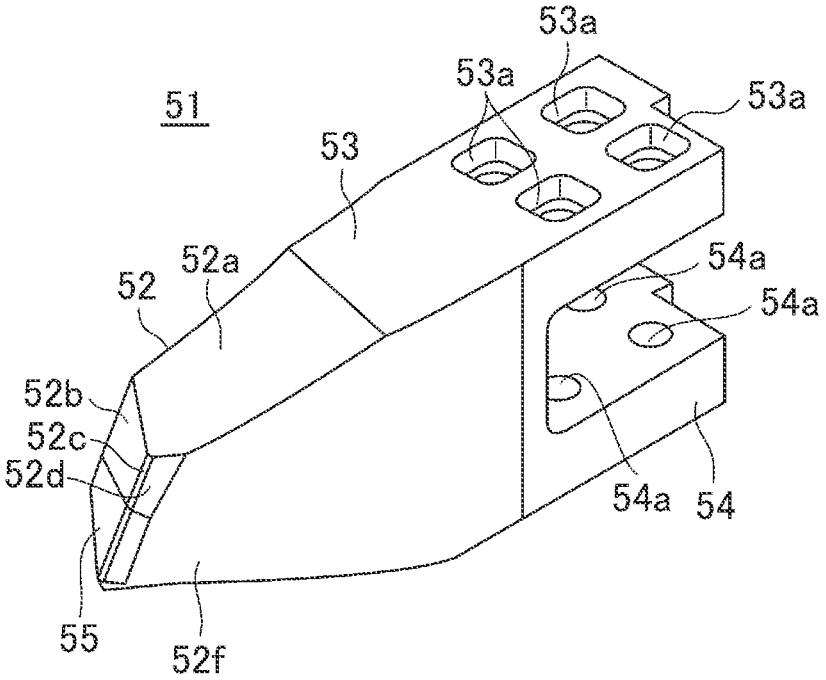

[FIG.12]
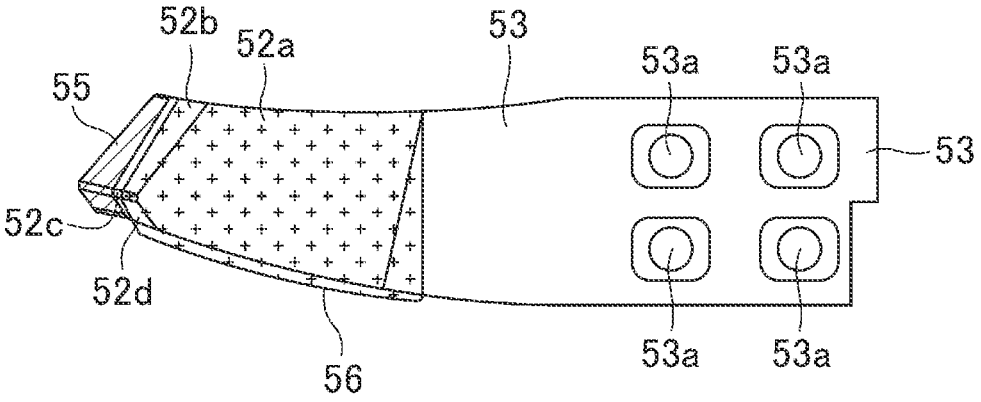
(a)
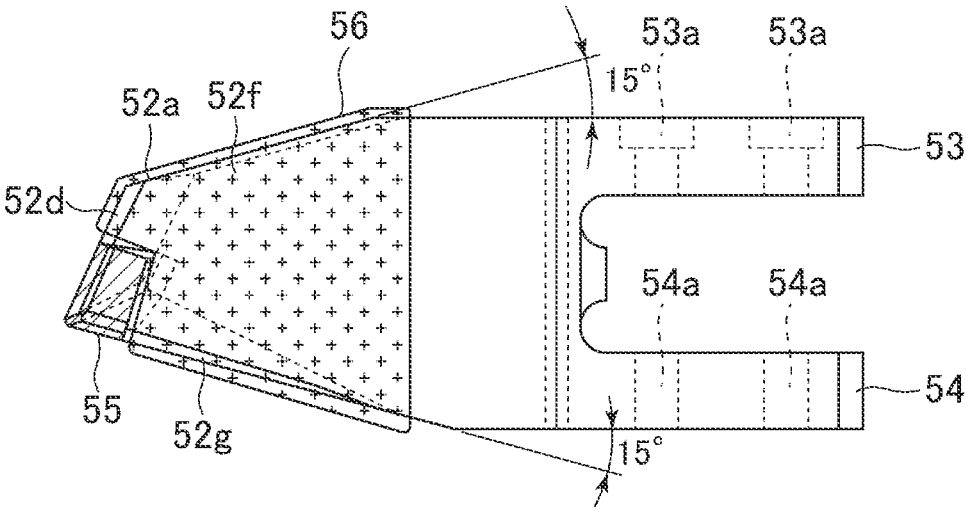

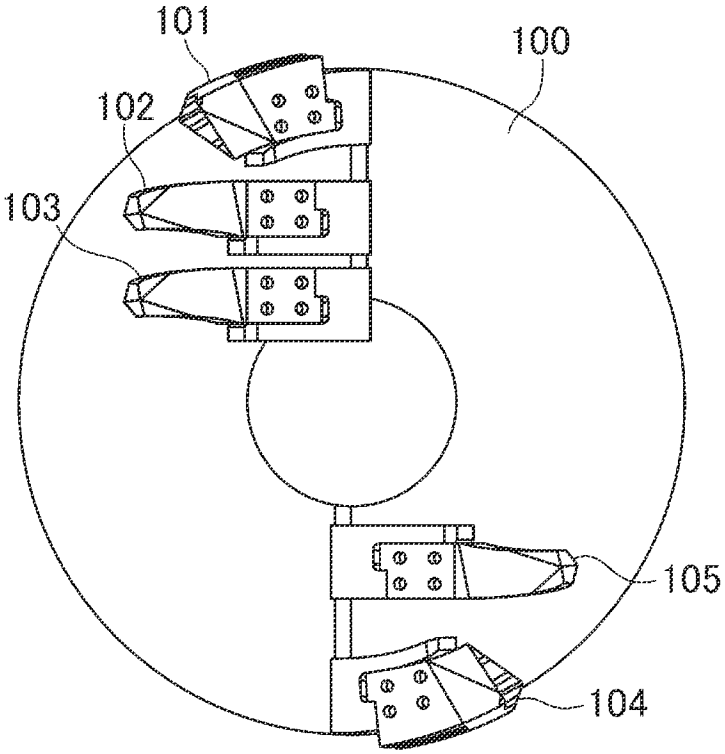
(b)
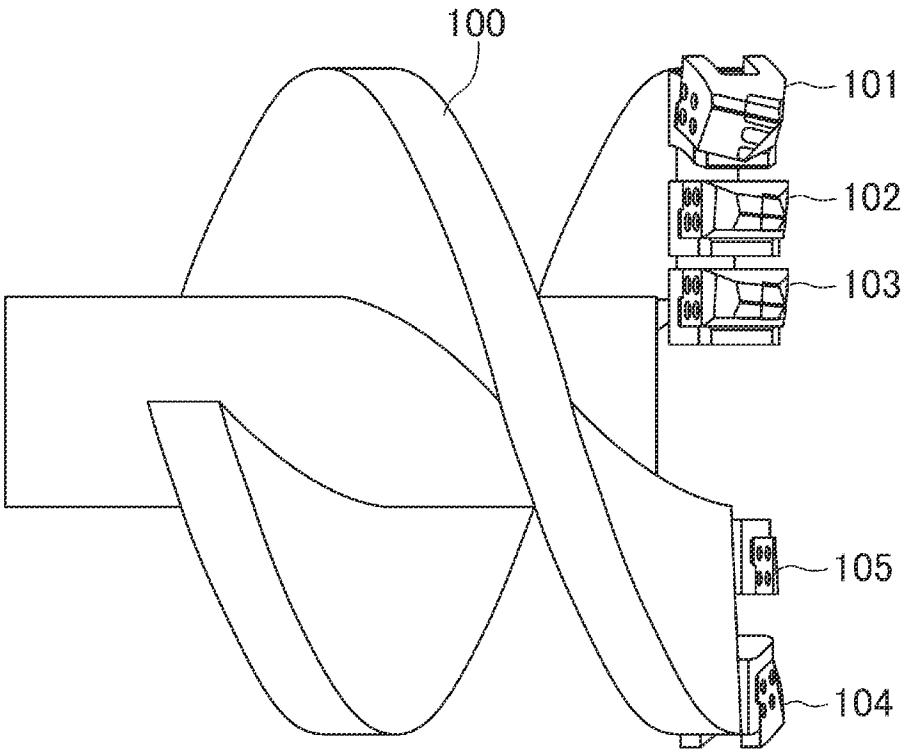
(a)
[FIG. 13]

AUGER BIT

CROSS REFERENCE TO RELATED APPLICATION

This is a U.S. national phase application under 35 USC 371 of International Application PCT/JP2020/019046 (not published in English), filed May 13, 2020.

TECHNICAL FIELD

The present invention relates to an auger bit for an auger head.

BACKGROUND ART

In an existing pile working method using a pile driver, for example, an auger head is connected to a drive mechanism, a foundation hole for a building, a construction hole for a continuous underground wall, or the like is excavated in the ground, and a cutting part for excavation is provided to an auger bit provided at a leading end of the auger head. This is substantially same for a steel pipe inner excavation working method and the like.

For example, Patent Literature 1 discloses a removable earth auger bit including a bit body, a bit holder, and a coupling member, in which the bit body includes an excavation head including an excavation blade made of a superhard alloy, and a shank part provided continuously with the excavation head, the shank part includes a middle constriction part and circular parts and has a cross-section of a substantially 8-figure shape, a semi-opened retaining recess is formed at a substantially middle site in a longitudinal direction, the bit holder has a receiving hole that is drilled through an end face of the bit holder and into which the shank part is inserted, and also has an attachment hole drilled through each of upper and lower surfaces of the bit holder, intersecting the receiving hole, and having a hole shape complemented by the retaining recess of the shank part, and a middle part of the coupling member is positioned in the retaining recess of the shank part when the coupling member is inserted into the attachment hole of the bit holder.

CITATION LIST

Patent Literature

Patent Literature 1: Japanese Patent Laid-open No. 2002-339680

SUMMARY OF INVENTION

Technical Problem

However, Patent Literature 1 merely discloses a removable earth auger bit and an earth auger that have an improved removable structure.

Conventionally, there have been no auger-head auger bit that has a tapered shape and an R shape curved at a predetermined curvature to achieve improved excavation efficiency, nor auger-head auger bit that has a larger bit width to avoid loss and improve abrasion resistance, improves the excavation efficiency while ensuring an excavation diameter, and further improves the excavation efficiency by preventing interference with a guide by employing an R shape.

The present invention is achieved in view of such a problem and intended to provide an auger-head auger bit having improved excavation efficiency.

Solution to Problem

To solve the above-described problem, an auger bit according to a first aspect of the present invention is an auger bit mounted on an auger head, the auger bit including: a base part having a leading end protruding in an axial direction of the auger head; and two leg parts continuously extending from the base part and facing each other at a predetermined interval, the base part includes a plane part parallel to and continuous with planes of the leg parts, a first tilted part that is tilted from the plane part toward a side closer to the leading end in the axial direction of the auger head, a second tilted part and a third tilted part that are continuous with the first tilted part, a first side surface part continuous with the second tilted part, a second side surface part continuous with the third tilted part, and a fourth tilted part that is tilted from the first to third tilted parts toward a side closer to the leg parts in the axial direction of the auger head, a superhard chip is disposed across parts of the first side surface part and the fourth tilted part at a lower end part where the second tilted part is continuous with the first side surface part and the fourth tilted part, a superhard chip is disposed across a part of the fourth tilted part at a lower substantially central part of the second tilted part, a superhard chip is disposed across the first to third tilted parts, the second side surface part, and the fourth tilted part at a lower end part where the first to third tilted parts are continuous with each other, the second side surface part, and the fourth tilted part, and the plane part and the leg parts each have a shape curved at a predetermined curvature relative to the axial direction of the auger head.

An auger bit according to a second aspect of the present invention is the auger bit according to the first aspect in which the base part has a wide shape of a width of 85 mm to 105 mm in a width direction of the plane part of the auger head on the side closer to the leg parts.

An auger bit according to a third aspect of the present invention is an auger bit mounted on an auger head, the auger bit including: a base part having a leading end protruding in an axial direction of the auger head; and two leg parts continuously extending from the base part and facing each other at a predetermined interval, the base part includes a plane part continuous with planes of the leg parts, a first tilted part that is tilted from the plane part toward a side closer to the leading end in the axial direction of the auger head, a side surface part continuous with the first tilted part, and a second tilted part tilted from the first tilted part toward the side closer to the leg parts in the axial direction of the auger head, the plane part of the base part has a tapered elongated shape of a width that gradually decreases toward the side closer to the leading end so that a length of a side along which the plane part is continuous with the first tilted part and the second tilted part on the side closer to the leading end is smaller than a length of a side along which the plane part is continuous with the one leg part on the side closer to the leg parts, and the plane part and the leg parts each have a shape curved at a predetermined curvature relative to the axial direction of the auger head.

Advantageous Effects of Invention

The present invention can provide an auger bit having improved excavation efficiency for a casing auger.

BRIEF DESCRIPTION OF DRAWINGS

FIG. 1 is a perspective view of an auger bit according to a first embodiment of the present invention.

FIG. 2 is a configuration diagram of the auger bit according to the first embodiment of the present invention.

FIG. 3 is a perspective view of an auger bit according to a second embodiment of the present invention.

FIG. 4 is a configuration diagram of the auger bit according to the second embodiment of the present invention.

FIG. 5 is a perspective view of an auger bit according to a third embodiment of the present invention.

FIG. 6 is a configuration diagram of the auger bit according to the third embodiment of the present invention.

FIG. 7 is a perspective view of an auger bit according to a fourth embodiment of the present invention.

FIG. 8 is a configuration diagram of the auger bit according to the fourth embodiment of the present invention.

FIG. 9 is a perspective view of an auger bit according to a fifth embodiment of the present invention.

FIG. 10 is a configuration diagram of the auger bit according to the fifth embodiment of the present invention.

FIG. 11 is a perspective view of an auger bit according to a sixth embodiment of the present invention.

FIG. 12 is a configuration diagram of the auger bit according to the sixth embodiment of the present invention.

FIG. 13 is a diagram illustrating a status in which an auger bit is attached to an auger head.

DESCRIPTION OF EMBODIMENTS

Configurations and effects of auger bits for a casing auger according to first to sixth embodiments of the present invention will be described below in detail with reference to the accompanying drawings.

First Embodiment

The configuration of an auger bit according to a first embodiment of the present invention will be described below with reference to FIGS. 1, 2(*a*), and 2(*b*). More specifically, FIG. 1 is a perspective view of the auger bit, FIG. 2(*a*) is a plan view thereof, and FIG. 2(*b*) is a side view thereof.

As illustrated in these diagrams, an auger bit 1 includes a base part 2, and two leg parts 3 and 4 extending from the base part 2. In the first embodiment, a side closer to the base part 2 is also referred to as a leading end of the auger bit 1, and a side closer to the leg parts 3 and 4 is also referred to as an auger-head mounting side or a rear end of the auger bit 1.

The base part 2 has what is called a chevron shape having a top part protruding toward the leading end side of the auger bit 1 in an axial direction of an auger head. More specifically, a plane part 2*a* of the base part 2 of the auger bit 1 is parallel to planes of the leg parts 3 and 4 and continuous with three tilted parts 2*b*, 2*c*, and 2*d* that are tilted toward the leading end side in the axial direction of the auger head.

In this example, a left end of the tilted part 2*b* when viewed from the leading end side in the axial direction of the auger head is continuous with a side surface part 2*e*, and a right end of the tilted part 2*d* when viewed from the leading end side in the axial direction of the auger head is continuous with a side surface part 2*f*.

The tilted parts 2*b*, 2*c*, and 2*d* of the base part 2 are continuous in the stated order in a lateral direction when viewed from the leading end side in the axial direction of the auger head, in other words, in a circumferential direction of the auger head. In this example, the tilted part 2*b* is tilted relative to the tilted part 2*c* in the circumferential direction of the auger head, and the tilted part 2*d* is tilted relative to the tilted part 2*c* in the circumferential direction of the auger head (direction opposite to the direction in which the tilted part 2*c* is tilted) of the tilted part 2*b*.

Lower ends of the tilted parts 2*b*, 2*c*, and 2*d* of the base part 2 are continuous with a tilted part 2*g*. The tilted part 2*g* is tilted toward the rear end side in the axial direction of the auger head, in other words, the auger-head mounting side of the auger bit 1 at 15° relative to a plane parallel to the plane part 2*a*. Note that, in this example, a hard building-up 6 is disposed at the base part 2.

The leg parts 3 and 4 extend with a predetermined interval therebetween in a U shape from the base part 2 toward the rear end side in the axial direction of the auger head. The leg parts 3 and 4 are provided with four holes 3*a* and four holes 4*a*, respectively, for mounting the auger bit 1 on the auger head with bolts or the like.

Superhard chips 5*a*, 5*b*, and 5*c* are disposed at the tilted parts 2*b*, 2*c*, and 2*d* of the base part 2 of the auger bit 1. More specifically, the superhard chip 5*a* is disposed also across a part of the side surface part 2*e* and the tilted part 2*g* at a lower end part where the tilted part 2*b* is continuous with the side surface part 2*e* and the tilted part 2*g*. The superhard chip 5*b* is disposed across parts of the tilted parts 2*b*, 2*c*, 2*d*, and 2*g* at a lower end part where the tilted parts 2*b*, 2*c*, and 2*d* are continuous with each other. The superhard chip 5*c* is disposed also across parts of the side surface part 2*f* and the tilted part 2*g* at a lower end part where the tilted part 2*d* is continuous with the side surface part 2*f* and the tilted part 2*g*.

With the superhard chips 5*a* to 5*c*, abrasion outside a contact surface can be prevented. Moreover, the materials and hardness of a plurality of superhard chips can be freely combined as appropriate in accordance with soil or an obstacle as an excavation target. For example, in the auger bit 1 according to the first embodiment, the superhard chips can be optionally selected from among superhard chips of five materials at maximum and used in combination so that loss and the like at excavation of a wide variety of excavation targets can be effectively prevented.

The base part 2 of the auger bit 1 has a shape bilaterally symmetric with respect to a target axis that is a line segment passing through the center of the plane part 2*a* in the axial direction of the auger head. In this manner, protection performance is increased with the bilaterally symmetric shape as well as a configuration in which respective surfaces of the tilted parts 2*b* to 2*d* and 2*g* are tilted at angles and superhard bits are arrayed at predetermined intervals as described above.

As for materials, parent materials of the leg parts 3 and 4 may be SCM440 (chromium/molybdenum steel) or the like, and the materials of the superhard chips 5*a* to 5*c* may be E3 (material name: MG30), E4 (material name: MG40), E5 (material name: MG50), E6 (material name: MG60), or the like among the JIS usage classification symbols or may be G4 (CIS material symbol: VC-40), G5 (CIS material symbol: VC-50), or the like in the CIS standard.

As described above, according to the first embodiment of the present invention, since the three divided superhard chips are provided, cutting edges of the auger bit are less likely to suffer loss and abrasion, thereby achieving improved excavation efficiency. Moreover, the auger bit needs to be less frequently replaced because not all superhard chips become unusable due to loss at one place unlike a configuration in which the superhard chips are integrated.

Second Embodiment

The configuration of an auger bit according to a second embodiment of the present invention will be described below with reference to FIGS. 3, 4(*a*), and 4(*b*). More specifically, FIG. 3 is a perspective view of the auger bit, FIG. 4(*a*) is a plan view thereof, and FIG. 4(*b*) is a side view thereof.

As illustrated in these diagrams, an auger bit 11 includes a base part 12, and two leg parts 13 and 14 extending from the base part 12. In the second embodiment, a side closer to the base part 12 is also referred to as a leading end of the auger bit 11, and a side closer to the leg parts 13 and 14 is also referred to as an auger-head mounting side or a rear end of the auger bit 11.

The base part 12 has what is called a chevron shape having a top part protruding toward the leading end side of the auger bit 11 in an axial direction of the auger head. More specifically, a plane part 12*a* of the base part 12 of the auger bit 11 is parallel to planes of the leg parts 13 and 14 and continuous with three tilted parts 12*b*, 12*c*, and 12*d* that are tilted toward the leading end side in the axial direction of the auger head.

In this example, a left end of the tilted part 12*b* when viewed from the leading end side in the axial direction of the auger head is continuous with a side surface part 12*e*, and a right end of the tilted part 12*d* when viewed from the leading end side in the axial direction of the auger head is continuous with a side surface part 12*f*.

The tilted parts 12*b*, 12*c*, and 12*d* of the base part 12 are continuous in the stated order in a lateral direction when viewed from the leading end side in the axial direction of the auger head, in other words, in a circumferential direction of the auger head. In this example, the tilted part 12*b* is tilted relative to the tilted part 12*c* in the circumferential direction of the auger head, and the tilted part 12*d* is tilted relative to the tilted part 12*c* in the circumferential direction of the auger head (direction opposite to a direction in which the tilted part 12*b* is tilted) of the tilted part 12*b*.

Lower ends of the tilted parts 12*b*, 12*c*, and 12*d* of the base part 12 are continuous with a tilted part 12*g*. The tilted part 12*g* is tilted toward the rear end side in the axial direction of the auger head, in other words, the auger-head mounting side of the auger bit 11 at 15° relative to a plane parallel to the plane part 12*a*. Note that, in this example, a hard building-up 16 is disposed at the base part 12.

The leg parts 13 and 14 extend with a predetermined interval therebetween in a U shape from the base part 12 toward the rear end side in the axial direction of the auger head. The leg parts 13 and 14 are provided with four holes 13*a* and four holes 14*a*, respectively, for mounting the auger bit 11 on the auger head with bolts or the like.

One superhard chip 15 is disposed at lower parts of the tilted parts 12*b*, 12*c*, and 12*d* of the base part 12 of the auger bit 11. With the superhard chip 15, abrasion outside a contact surface can be prevented. Moreover, the material and hardness of the superhard chip can be freely combined as appropriate in accordance with soil or an obstacle as an excavation target.

As for the material of each component, parent materials of the leg parts 13 and 14 may be SCM440 (chromium/molybdenum steel) or the like. The material of the superhard chip 15 may be E3 (material name: MG30), E4 (material name: MG40), E5 (material name: MG50), E6 (material name: MG60), or the like among the JIS usage classification symbols or may be G4 (CIS material symbol: VC-40), G5 (CIS material symbol: VC-50), or the like in the CIS standard.

The plane part 12*a* of the base part 12 and the leg parts 13 and 14 of the auger bit 11 each have an R shape curved relative to the axial direction of the auger head at a predetermined curvature in accordance with the diameter of the auger head. In this example, it is designed that leading ends of cutting edges are positioned on a circumference of ϕ850 mm, and the R shape has a curvature of R500 (inner periphery R395 (wide R shape)). With such a configuration, efficiency of excavation at the outer periphery of the auger head can be improved when a holder dedicated for the auger head is used together.

As described above, according to the second embodiment of the present invention, since the plane part and the like each have an R shape curved at a predetermined curvature in accordance with the diameter of the auger head, it is possible to prevent interference with a guide casing and thus reduce loss of cutting edges due to collision with the guide casing. In addition, with the R shape, the cutting edges are positioned not at middle positions but on the outer side so that excavation is performed further on the outer side than when the cutting edges are positioned at the middle positions, which enables not only securement of an excavation diameter but also size increase thereof. Moreover, with the R shape, it is possible to reduce a load at excavation, thereby achieving improved excavation efficiency.

Third Embodiment

The configuration of an auger bit according to a third embodiment of the present invention will be described below with reference to FIGS. 5, 6(*a*), and 6(*b*). More specifically, FIG. 5 is a perspective view of the auger bit, FIG. 6(*a*) is a side view thereof, and FIG. 6(*b*) is a bottom view thereof.

As illustrated in these diagrams, an auger bit 21 includes a base part 22, and two leg parts 23 and 24 extending from the base part 22. In the second embodiment, a side closer to the base part 22 is also referred to as a leading end of the auger bit 21, and a side closer to the leg parts 23 and 24 is also referred to as an auger-head mounting side or a rear end of the auger bit 21.

The base part 22 has what is called a chevron shape having a top part protruding toward the leading end side of the auger bit 21 in an axial direction of the auger head. More specifically, a plane part 22*a* of the base part 22 of the auger bit 21 is parallel to planes of the leg parts 23 and 24 and continuous with three tilted parts 22*b*, 22*c*, and 22*d* that are tilted toward the leading end side in the axial direction of the auger head.

In this example, a left end of the tilted part 22*b* when viewed from the leading end side in the axial direction of the auger head is continuous with a side surface part 22*e*, and a right end of the tilted part 22*d* when viewed from the leading end side in the axial direction of the auger head is continuous with a side surface part 22*f*.

The tilted parts 22*b*, 22*c*, and 22*d* of the base part 22 are continuous in the stated order in a lateral direction when viewed from the leading end side in the axial direction of the auger head, in other words, in a circumferential direction of the auger head. In this example, the tilted part 22*b* is tilted relative to the tilted part 22*c* in the circumferential direction of the auger head, and the tilted part 22*d* is tilted relative to the tilted part 22*c* in the circumferential direction of the auger head (direction opposite to a direction in which the tilted part 22*b* is tilted) of the tilted part 22*b*.

Lower ends of the tilted parts 22*b*, 22*c*, and 22*d* of the base part 22 are continuous with a tilted part 22*g*. The tilted part 22*g* is tilted toward the rear end side in the axial direction of the auger head, in other words, the auger-head mounting side of the auger bit 21 at 15° relative to a plane parallel to the plane part 22*a*. Note that, in this example, a hard building-up 26 is disposed at the base part 22.

The leg parts 23 and 24 extend with a predetermined interval therebetween in a U shape from the base part 22 toward the rear end side in the axial direction of the auger head. The leg parts 23 and 24 are provided with four holes 23*a* and four holes 24*a*, respectively, for mounting the auger bit 21 on the auger head with bolts or the like.

One superhard chip 25 is disposed at lower parts of the tilted parts 22*b*, 22*c*, and 22*d* of the base part 22 of the auger bit 21. With the superhard chip 25, abrasion outside a contact surface can be prevented. Moreover, the materials and hardness of a plurality of superhard chips can be freely combined as appropriate in accordance with soil or an obstacle as an excavation target.

As for the material of each component, parent materials of the leg parts 23 and 24 may be SCM440 (chromium/molybdenum steel) or the like. The material of the superhard chip 25 may be E3 (material name: MG30), E4 (material name: MG40), E5 (material name: MG50), E6 (material name: MG60), or the like among the JIS usage classification symbols or may be G4 (CIS material symbol: VC-40), G5 (CIS material symbol: VC-50), or the like in the CIS standard.

The plane part 22*a* of the base part 22 and the leg parts 23 and 24 of the auger bit 21 have cutting edges wider than those of a typical auger bit. Specifically, a width of the plane part 22*a* in a direction orthogonal to the axial direction of the auger head, in other words, in the circumferential direction of the auger head is larger than that of a typical auger bit.

More specifically, the width of the plane part 22*a* in the direction orthogonal to the axial direction of the auger head is larger than that of a typical auger bit. For example, it is typical that, in a typical auger bit for a casing auger, a cutting edge width is equal to a holder width like the cutting edge width is 60 mm for a holder of 60 mm width and is 80 mm for a holder of 80 mm width, but the auger bit according to the present embodiment has such a wide shape that the cutting edge width is 85 mm for a holder of 60 mm width and is 105 mm for a holder of 80 mm width, and thus an already mounted holder can be used for the auger bit.

Conventionally, to increase the width of the auger head, it has been needed to increase the sizes of holders or weld auger bits for an auger of 20 to 25 mm width, but with the above-described configuration, auger bits can be used only by mounting the auger bits on existing holders.

As described above, according to the third embodiment of the present invention, loss and abrasion of auger bits can be prevented with the wide shape. Moreover, auger bits can be mounted by utilizing existing holders of the auger head.

Fourth Embodiment

The configuration of an auger bit according to a fourth embodiment of the present invention will be described below with reference to FIGS. 7, 8(*a*), and 8(*b*). More specifically, FIG. 7 is a perspective view of the auger bit, FIG. 8(*a*) is a plan view thereof, and FIG. 8(*b*) is a side view thereof.

As illustrated in these diagrams, an auger bit 31 includes a base part 32, and two leg parts 33 and 34 extending from the base part 32. In the fourth embodiment, a side closer to the base part 32 is also referred to as a leading end of the auger bit 31, and a side closer to the leg parts 33 and 34 is also referred to as an auger-head mounting side or a rear end of the auger bit 31.

The base part 32 has what is called a chevron shape having a top part protruding toward the leading end side of the auger bit 31 in an axial direction of the auger head. More specifically, a plane part 32*a* of the base part 32 of the auger bit 31 is parallel to planes of the leg parts 33 and 34 and continuous with three tilted parts 32*b*, 32*c*, and 32*d* that are tilted toward the leading end side in the axial direction of the auger head.

In this example, a left end of the tilted part 32*b* when viewed from the leading end side in the axial direction of the auger head is continuous with a side surface part 32*e*, and a right end of the tilted part 32*d* when viewed from the leading end side in the axial direction of the auger head is continuous with a side surface part 32*f*.

The tilted parts 32*b*, 32*c*, and 32*d* of the base part 32 are continuous in the stated order in a lateral direction when viewed from the leading end side in the axial direction of the auger head, in other words, in a circumferential direction of the auger head. In this example, the tilted part 32*b* is tilted relative to the tilted part 32*c* in the circumferential direction of the auger head, and the tilted part 32*d* is tilted relative to the tilted part 32*c* in the circumferential direction of the auger head (direction opposite to a direction in which the tilted part 32*b* is tilted) of the tilted part 32*b*.

Lower ends of the tilted parts 32*b*, 32*c*, and 32*d* of the base part 32 are continuous with a tilted part 32*g*. The tilted part 32*g* is tilted toward the rear end side in the axial direction of the auger head, in other words, the auger-head mounting side of the auger bit 31 at 15° relative to a plane parallel to the plane part 32*a*. Note that, in this example, a hard building-up 36 is disposed at the base part 32.

The leg parts 33 and 34 extend with a predetermined interval therebetween in a U shape from the base part 32 toward the rear end side in the axial direction of the auger head. The leg parts 33 and 34 are provided with four holes 33*a* and four holes 34*a*, respectively, for mounting the auger bit 31 to the auger head with bolts or the like.

Superhard chips 35*a*, 35*b*, and 35*c* are disposed at the tilted parts 32*b*, 32*c*, and 32*d* of the base part 32 of the auger bit 31. More specifically, the superhard chip 35*a* is disposed also across parts of the side surface part 32*e* and the tilted part 32*g* at a lower end part where the tilted part 32*b* is continuous with the side surface part 32*e* and the tilted part 32*g*. The superhard chip 35*b* is disposed also across a part of the tilted part 32*g* at a lower substantially central part of the tilted part 2*b*. The superhard chip 35*c* is disposed across the tilted parts 32*b*, 32*c*, and 32*d*, the side surface part 32*f*, and the tilted part 32*g* at a lower end part where the tilted parts 32*b*, 32*c*, and 32*d*, the side surface part 32*f*, and the tilted part 32*g* are continuous with each other.

With the superhard chips 35*a* to 35*c*, abrasion outside a contact surface can be prevented. Moreover, the materials and hardness of a plurality of superhard chips can be freely combined as appropriate in accordance with soil or an obstacle as an excavation target. For example, in the auger bit 31 according to the present embodiment, the superhard chips can be optionally selected from among superhard chips of five materials at maximum and used in combination so that loss and the like at excavation of a wide variety of excavation targets can be effectively prevented.

As for materials, parent materials of the leg parts 33 and 34 may be SCM440 (chromium/molybdenum steel) or the like. The materials of the superhard chips 35*a* to 35*c* may be E3 (material name: MG30), E4 (material name: MG40), E5 (material name: MG50), E6 (material name: MG60), or the like among the JIS usage classification symbols or may be G4 (CIS material symbol: VC-40), G5 (CIS material symbol: VC-50), or the like in the CIS standard.

The plane part 32*a* of the base part 32 and the leg parts 33 and 34 of the auger bit 31 each have an R shape curved relative to the axial direction of the auger head at a predetermined curvature in accordance with the diameter of the auger head. In the present example, it is designed that leading ends of cutting edges are positioned on a circumference of ϕ850 mm, and the R shape has a curvature of R475. With such a configuration, efficiency of excavation at the outer periphery of the auger head can be improved when a holder dedicated for the auger head is used together.

The plane part 32*a* of the base part 32 and the leg parts 33 and 34 of the auger bit 31 have cutting edges wider than those of a typical auger bit. Specifically, a width of the plane part 32*a* in a direction orthogonal to the axial direction of the auger head, in other words, in the circumferential direction of the auger head is larger than that of a typical auger bit.

Specifically, the width of the plane part 32*a* in the direction orthogonal to the axial direction of the auger head is larger than that of a typical auger bit.

For example, it is typical that, in a typical auger bit for a casing auger, a cutting edge width is equal to a holder width like the cutting edge width is 60 mm for a holder of 60 mm width and is 80 mm for a holder of 80 mm width, but the auger bit according to the fourth embodiment has such a wide shape that the cutting edge width is 85 mm for a holder of 60 mm width and is 105 mm for a holder of 80 mm width, and thus an already mounted holder can be used for the auger bit.

As described above, according to the fourth embodiment of the present invention, since the three divided superhard chips are provided, cutting edges of the auger bit are less likely to suffer loss and abrasion, thereby achieving improved excavation efficiency. Moreover, the auger bit needs to be less frequently replaced because not all superhard chips become unusable due to loss at one place unlike a configuration in which the superhard chips are integrated.

In addition, according to the fourth embodiment, since the plane part of the base part has an R shape, it is possible to prevent interference with a guide casing and thus reduce loss of cutting edges due to collision with the guide casing. The cutting edges are positioned not at middle positions but on the outer side so that excavation is performed further on the outer side than when the cutting edges are positioned at the middle positions, which enables securement of an excavation diameter and size increase thereof. Moreover, since the R shape has a curvature in accordance with the diameter of the auger head, it is possible to reduce a load at excavation, thereby achieving improved excavation efficiency.

In addition, according to the fourth embodiment, loss and abrasion of auger bits can be prevented with the wide shape. Moreover, auger bits can be mounted by utilizing existing holders of the auger head.

Fifth Embodiment

The configuration of an auger bit according to a fifth embodiment of the present invention will be described below with reference to FIGS. 9, 10(*a*), and 10(*b*). More specifically, FIG. 9 is a perspective view of the auger bit, FIG. 10(*a*) is a plan view thereof, and FIG. 10(*b*) is a side view thereof.

As illustrated in these diagrams, an auger bit 41 includes a base part 42, and two leg parts 43 and 44 extending from the base part 42. In the fifth embodiment, a side closer to the base part 42 is also referred to as a leading end of the auger bit 41, and a side closer to the leg parts 43 and 44 is also referred to as an auger-head mounting side or a rear end of the auger bit 41.

The base part 42 has what is called a chevron shape having a top part protruding toward the leading end side of the auger bit 41 in an axial direction of the auger head. More specifically, a plane part 42*a* of the base part 42 of the auger bit 41 is tilted downward at 15° toward the leading end side of the auger head relative to planes of the leg parts 43 and 44 and is continuous with three tilted parts 42*b*, 42*c*, and 42*d* that are further tilted toward the leading end side in the axial direction of the auger head.

In this example, a left end of the tilted part 42*b* when viewed from the leading end side in the axial direction of the auger head is continuous with a side surface part 42*e*, and a right end of the tilted part 42*d* when viewed from the leading end side in the axial direction of the auger head is continuous with a side surface part 42*f*.

The tilted parts 42*b*, 42*c*, and 42*d* of the base part 42 are continuous in the stated order in a lateral direction when viewed from the leading end side in the axial direction of the auger head, in other words, in a circumferential direction of the auger head. In this example, the tilted part 42*b* is tilted relative to the tilted part 42*c* in the circumferential direction of the auger head, and the tilted part 42*d* is tilted relative to the tilted part 42*c* in the circumferential direction of the auger head (direction opposite to a direction in which the tilted part 42*b* is tilted) of the tilted part 42*b*.

Lower ends of the tilted parts 42*b*, 42*c*, and 42*d* of the base part 42 are continuous with a tilted part 42*g*. The tilted part 42*g* is tilted toward the rear end side in the axial direction of the auger head, in other words, the auger-head mounting side of the auger bit 41 at 15° relative to a plane parallel to the plane part 42*a*. Note that, in this example, a hard building-up 46 is disposed at the base part 42.

The leg parts 43 and 44 extend with a predetermined interval therebetween in a U shape from the base part 42 toward the rear end side in the axial direction of the auger head. The leg parts 43 and 44 are provided with four holes 43*a* and four holes 44*a*, respectively, for mounting the auger bit 41 on the auger head with bolts or the like.

One superhard chip 45 is disposed at lower parts of the tilted parts 42*b*, 42*c*, and 42*d* of the base part 42 of the auger bit 41. With the superhard chip 45, abrasion outside a contact surface can be prevented. Moreover, the material and hardness of the superhard chip can be freely selected as appropriate in accordance with soil or an obstacle as an excavation target.

As for the material of each component, parent materials of the leg parts 43 and 44 may be SCM440 (chromium/molybdenum steel) or the like. The material of the superhard chip 45 may be E3 (material name: MG30), E4 (material name: MG40), E5 (material name: MG50), E6 (material name: MG60), or the like among the JIS usage classification symbols or may be G4 (CIS material symbol: VC-40), G5 (CIS material symbol: VC-50), or the like in the CIS standard.

The base part 42 of the auger bit 41 has a tapered elongated shape as compared to that of a typical auger bit and thus can provide a desirable bite into an excavation target, which leads to improved excavation efficiency.

More specifically, the cutting edge width is 60 mm for a holder of 60 mm width and is 80 mm for a holder of 80 mm width in a case of a typical auger bit, but the cutting edge width is 40 mm for a holder of 60 mm width and is 50 mm for a holder of 80 mm width in a case of the auger bit 41 according to the fifth embodiment. In the illustrated example, the plane part 42*a* of the base part 42 has such a tapered shape that the plane thereof has a maximum width of 80 mm and a minimum width of 50 mm, and the width gradually decreases from 80 mm to 50 mm as the position becomes closer to the leading end side.

Moreover, the cutting edge of a typical auger bit has a width of 60 mm and a length of 185 mm for a holder of 60 mm width and has a width of 80 mm and a length of 215 mm for a holder of 80 mm width, but the cutting edge of the auger bit 41 according to the fifth embodiment has a width of 40 mm and a length of 250 mm for a holder of 60 mm width, and has a width of 50 mm and a length of 280 mm or 310 mm for a holder of 80 mm width.

The auger bit according to the fifth embodiment may be used together with an existing auger bit or may be used alone. Specifically, for example, three kinds of auger bits, namely, normal auger bits of lengths 280 mm and 310 mm and the auger bit according to the present embodiment may be used together in a case in which the cutting edge has a width of 50 mm and a length of 280 mm or 310 mm for a holder of 80 mm width.

As described above, according to the fifth embodiment of the present invention, the base part of the auger bit has a tapered elongated shape and thus can provide a desirable bite into an excavation target, which leads to improved excavation efficiency.

Sixth Embodiment

The configuration of an auger bit according to a sixth embodiment of the present invention will be described below with reference to FIGS. 11, 12(*a*), and 12(*b*). More specifically, FIG. 11 is a perspective view of the auger bit, FIG. 12(*a*) is a plan view thereof, and FIG. 12(*b*) is a side view thereof.

As illustrated in these diagrams, an auger bit 51 includes a base part 52, and two leg parts 53 and 54 extending from the base part 52. In the sixth embodiment, a side closer to the base part 52 is also referred to as a leading end of the auger bit 51, a side closer to the leg parts 53 and 54 is also referred to as an auger-head mounting side or a rear end of the auger bit 51.

The base part 52 has what is called a chevron shape having a top part protruding toward the leading end side of the auger bit 51 in an axial direction of the auger head. More specifically, a plane part 52*a* of the base part 52 of the auger bit 51 is tilted downward at 15° toward the leading end side of the auger head relative to planes of the leg parts 53 and 54 and is continuous with three tilted parts 52*b*, 52*c*, and 52*d* that are further tilted toward the leading end side in the axial direction of the auger head.

In this example, a left end of the tilted part 52*b* when viewed from the leading end side in the axial direction of the auger head is continuous with a side surface part 52*e*, and a right end of the tilted part 52*d* when viewed from the leading end side in the axial direction of the auger head is continuous with a side surface part 52*f*.

The tilted parts 52*b*, 52*c*, and 52*d* of the base part 52 are continuous in the stated order in a lateral direction when viewed from the leading end side in the axial direction of the auger head, in other words, in a circumferential direction of the auger head. In this example, the tilted part 52*b* is tilted relative to the tilted part 52*c* in the circumferential direction of the auger head, and the tilted part 52*d* is tilted relative to the tilted part 52*c* in the circumferential direction of the auger head (direction opposite to a direction in which the tilted part 52*b* is tilted) of the tilted part 52*b*.

Lower ends of the tilted parts 52*b*, 52*c*, and 52*d* of the base part 52 are continuous with a tilted part 52*g*. The tilted part 52*g* is tilted toward the rear end side in the axial direction of the auger head, in other words, the auger-head mounting side of the auger bit 51 at 15° relative to a plane parallel to the plane part 52*a*. Note that, in this example, a hard building-up 56 is disposed at the base part 52.

The leg parts 53 and 54 extend with a predetermined interval therebetween in a U shape from the base part 52 toward the rear end side in the axial direction of the auger head. The leg parts 53 and 54 are provided with four holes 53*a* and four holes 54*a*, respectively, for mounting the auger bit 51 to the auger head with bolts or the like.

One superhard chip 55 is disposed at lower parts of the tilted parts 52*b*, 52*c*, and 52*d* of the base part 52 of the auger bit 51. With the superhard chip 55, abrasion outside a contact surface can be prevented. Moreover, the material and hardness of the superhard chip can be freely selected as appropriate in accordance with soil or an obstacle as an excavation target.

As for the material of each component, parent materials of the leg parts 53 and 54 may be SCM440 (chromium/molybdenum steel) or the like. The material of the superhard chip 55 may be E3 (material name: MG30), E4 (material name: MG40), E5 (material name: MG50), E6 (material name: MG60), or the like among the JIS usage classification symbols or may be G4 (CIS material symbol: VC-40), G5 (CIS material symbol: VC-50), or the like in the CIS standard.

The base part 52 of the auger bit 51 has a tapered elongated shape as compared to that of a typical auger bit and thus can provide a desirable bite into an excavation target, which leads to improved excavation efficiency.

More specifically, the cutting edge width is 60 mm for a holder of 60 mm width and is 80 mm for a holder of 80 mm width in a case of typical auger bit, but the cutting edge width is 40 mm for a holder of 60 mm width and is 50 mm for a holder of 80 mm width in a case of the auger bit 51 according to the present embodiment. In the illustrated example, the plane part 52*a* of the base part 52 has such a tapered shape that the plane thereof has a maximum width of 80 mm and a minimum width of 50 mm, and the width gradually decreases from 80 mm to 50 mm as the position becomes closer to the leading end side.

Moreover, the cutting edge of a typical auger bit has a width of 60 mm and a length of 185 mm for a holder of 60 mm width and has a width of 80 mm and a length of 215 mm for a holder of 80 mm width, but the cutting edge of the auger bit 51 according to the sixth embodiment has a width of 40 mm and a length of 250 mm for a holder of 60 mm width, and has a width of 50 mm and a length of 280 mm or 310 mm for a holder of 80 mm width.

The auger bit according to the present embodiment may be used together with an existing auger bit or may be used alone. Specifically, for example, three kinds of auger bits, namely, normal auger bits of lengths 280 mm and 310 mm and the auger bit according to the sixth embodiment may be used together in a case in which the cutting edge has a width of 50 mm and a length of 280 mm or 310 mm for a holder of 80 mm width.

The plane part 52*a* of the base part 52 and the leg parts 53 and 54 of the auger bit 51 each have an R shape curved relative to the axial direction of the auger head at a predetermined curvature in accordance with the diameter of the auger head. In the present embodiment, it is designed that leading ends of cutting edges are positioned on a circumference of ϕ850 mm, and the R shape has a curvature of outer periphery R475 and inner periphery R395. With such a configuration, efficiency of excavation at the outer periphery of the auger head can be improved when a holder dedicated for the auger head is used together.

As described above, according to the sixth embodiment of the present invention, the base part of the auger bit has a tapered elongated R shape and thus can provide a desirable bite into an excavation target, which leads to improved excavation efficiency.

Moreover, since the plane part of the base part has an R shape, it is possible to prevent interference with a guide casing and thus reduce loss of cutting edges due to collision with the guide casing. In addition, the cutting edge of the base part is positioned not at a middle position but on the outer side so that excavation is performed further on the outer side than when the cutting edge is positioned at the middle position, which enables size increase of the excavation diameter. Furthermore, since the R shape is curved at a predetermined curvature in accordance with the diameter of the auger head, it is possible to reduce a load at excavation, thereby achieving improved excavation efficiency.

Lastly, a status in which the auger bits according to the fourth embodiment and the sixth embodiment are attached to the auger head will be described with reference to FIG. 13. More specifically, FIG. 13(*a*) is a side view illustrating the attachment status, and FIG. 13(*b*) is a front view illustrating the attachment status.

As illustrated in these diagrams, an auger head 100 has what is called a screw shape, and at one of two bifurcated leading ends, an auger bit 101 according to the fourth embodiment and auger bits 102 and 103 according to the sixth embodiment are mounted in parallel in the stated order from outside toward a central part. At the other leading end, an auger bit 104 according to the fourth embodiment and an auger bit 105 according to the sixth embodiment are mounted in parallel in the stated order from outside toward the central part. In this manner, the auger bits 101 and 104 according to the fourth embodiment are disposed on the outermost side and have R shapes approximate to the R shape of the auger head 100 and thus achieve smooth rotation and excavation, and moreover, the auger bits 101 and 104 have wide shapes and thus have high resistance against damage due to abrasion or the like. In addition, the auger bits 102, 103, and 105 according to the sixth embodiment are disposed toward the central part and have tapered elongated shapes, and can achieve desirable excavation irrespective of the kind of an excavation target.

The first to sixth embodiments of the present invention are described above, but the present invention is not limited thereto and may be modified and changed in various kinds of manners without departing from the scope of the present invention.

For example, an auger bit for a casing auger according to each embodiment can be employed in, for example, work using an existing pile working method, a steel pipe inner excavation working method, or the like, and accordingly, crack, dropping, and abrasion of a superhard chip are less likely to occur during the work as compared to conventional cases.

REFERENCE SIGNS LIST

1 auger bit
2 base part
2*a* plane part
2*b*, 2*c*, 2*d* tilted part
2*e*, 2*f* side surface part
2*g* tilted part
3 leg part
3*a* hole
4 leg part
4*a* hole
5*a*, 5*b*, 5*c* superhard chip
6 hard building-up
11 auger bit
12 base part
12*a* plane part
12*b*, 12*c*, 12*d* tilted part
12*e*, 12*f* side surface part
12*g* tilted part
13 leg part
13*a* hole
14 leg part
14*a* hole
15 superhard chip
16 hard building-up
21 auger bit
22 base part
22*a* plane part
22*b*, 22*c*, 22*d* tilted part
22*e*, 22*f* side surface part
22*g* tilted part
23 leg part
23*a* hole
24 leg part
24*a* hole
25 superhard chip
26 hard building-up
31 auger bit
32 base part
32*a* plane part
32*b*, 32*c*, 32*d* tilted part
32*e*, 32*f* side surface part
32*g* tilted part
33 leg part
33*a* hole
34 leg part
34*a* hole
35*a*, 35*b*, 35*c* superhard chip
36 hard building-up
41 auger bit
42 base part
42*a* plane part
42*b*, 42*c*, 42*d* tilted part
42*e*, 42*f* side surface part
42*g* tilted part
43 leg part
43*a* hole
44 leg part
44*a* hole
45 superhard chip
46 hard building-up
51 auger bit

52 base part
52*a* plane part
52*b*, 52*c*, 52*d* tilted part
52*e*, 52*f* side surface part
52*g* tilted part
53 leg part
53*a* hole
54 leg part
54*a* hole
55 superhard chip
56 hard building-up

The invention claimed is:

1. An auger bit mounted on an auger head, the auger bit comprising:

a base part having a leading end protruding in an axial direction of the auger head; and two leg parts continuously extending from the base part and facing each other at a predetermined interval, wherein the base part includes a plane part parallel to and continuous with planes of the leg parts, a first tilted part that is tilted from the plane part toward a side closer to the leading end in the axial direction of the auger head, a second tilted part and a third tilted part that are continuous with the first tilted part, a first side surface part continuous with the second tilted part, a second side surface part continuous with the third tilted part, and a fourth tilted part that is tilted from the first and third tilted parts toward a side closer to the leg parts in the axial direction of the auger head, a first superhard chip is disposed across parts of the first side surface part and the fourth tilted part at a lower end part where the second tilted part is continuous with the first side surface part and the fourth tilted part, a second superhard chip is disposed across a part of the fourth tilted part at a lower substantially central part of the second tilted part, and a third superhard chip is disposed across the first and third tilted parts, the second side surface part, and the fourth tilted part at a lower end part where the first and third tilted parts are continuous with each other and the fourth tilted part, and the plane part and the leg parts each have a shape curved at a predetermined curvature relative to the axial direction of the auger head.

2. The auger bit according to claim 1, wherein the base part has a wide shape of a width of 85 mm to 105 mm in a width direction of the plane part of the auger head on the side closer to the leg parts.

3. An auger bit mounted on an auger head, the auger bit comprising:

a base part having a leading end protruding in an axial direction of the auger head; and two leg parts continuously extending from the base part and facing each other at a predetermined interval, wherein the base part includes a plane part continuous with planes of the leg parts, a first tilted part that is tilted from the plane part toward a side closer to the leading end in the axial direction of the auger head, a side surface part continuous with the first tilted part, and a second tilted part tilted from the first tilted part toward a side closer to the leg parts in the axial direction of the auger head, the plane part of the base part has a tapered elongated shape of a width that gradually decreases toward the side closer to the leading end so that a length of a side along which the plane part is continuous with the first tilted part and the second tilted part on the side closer to the leading end is smaller than a length of a side along which the plane part is continuous with the one leg part on the side closer to the leg parts, and the plane part and the leg parts each have a shape curved at a predetermined curvature relative to the axial direction of the auger head.

* * * * *